US010700454B1

(12) United States Patent
Blackburn et al.

(10) Patent No.: US 10,700,454 B1
(45) Date of Patent: Jun. 30, 2020

(54) CABLE CONNECTOR AND CABLE CONNECTOR ASSEMBLY FOR AN ELECTRICAL SYSTEM

(71) Applicant: TE CONNECTIVITY CORPORATION, Berwyn, PA (US)

(72) Inventors: Christopher William Blackburn, Bothell, WA (US); Richard Elof Hamner, Hummelstown, PA (US); Arash Behziz, Newbury Park, CA (US); Brian Patrick Costello, Scotts Valley, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/390,162

(22) Filed: Apr. 22, 2019

Related U.S. Application Data

(60) Provisional application No. 62/793,539, filed on Jan. 17, 2019.

(51) Int. Cl.

| | |
|---|---|
| ***H01R 12/53*** | (2011.01) |
| ***H01R 12/58*** | (2011.01) |
| ***H01R 11/28*** | (2006.01) |
| ***H01R 4/48*** | (2006.01) |
| ***H01R 11/32*** | (2006.01) |
| ***H01R 33/74*** | (2006.01) |
| ***H01R 12/71*** | (2011.01) |

(52) U.S. Cl.
CPC ..... *H01R 12/53* (2013.01); *H01R 4/48* (2013.01); *H01R 11/28* (2013.01); *H01R 11/32* (2013.01); *H01R 12/58* (2013.01); *H01R 12/714* (2013.01); *H01R 33/74* (2013.01)

(58) Field of Classification Search
CPC .. H01R 2103/00; H01R 24/50; H01R 23/688; H01R 13/65807; H01R 12/53; H01R 12/58; H01R 12/714; H01R 11/28; H01R 11/32; H01R 4/48; H01R 33/74
USPC ..... 439/582, 581, 607.06, 607.07
See application file for complete search history.

(56) References Cited

U.S. PATENT DOCUMENTS

| | | | | |
|---|---|---|---|---|
| 4,984,992 | A * | 1/1991 | Beamenderfer ..... | H01R 24/30 439/101 |
| 8,840,432 | B2 | 9/2014 | Alden, III et al. | |
| 8,845,364 | B2 * | 9/2014 | Wanha ..... | H01R 13/516 439/607.07 |
| 8,911,255 | B2 * | 12/2014 | Scherer ..... | H01R 24/00 439/607.07 |
| 9,011,177 | B2 | 4/2015 | Lloyd et al. | |
| 9,437,949 | B2 | 9/2016 | Behziz et al. | |

(Continued)

*Primary Examiner* — Gary F Paumen

(57) ABSTRACT

A cable connector includes a twin-axial cable having a first conductor and a second conductor within a core of the cable. The cable connector includes first and second signal contacts including cable terminals terminated to the conductors and substrate terminals generally perpendicular to the cable terminals and terminated to a substrate. The cable connector includes a contact holder having a body encasing portions of the first and second signal contacts. The contact holder has a front and a rear, and a top and a bottom. The cable terminals are arranged proximate to the rear for termination to the cable. The cable extends from the rear of the contact holder. The substrate terminals are exposed at the bottom for termination to the substrate.

20 Claims, 9 Drawing Sheets

(56) References Cited

U.S. PATENT DOCUMENTS

| | | | | |
|---|---|---|---|---|
| 2007/0141871 | A1* | 6/2007 | Scherer | H01R 23/688 439/108 |
| 2012/0052699 | A1 | 3/2012 | MacDougall | |
| 2012/0122335 | A1* | 5/2012 | Costello | H04Q 1/025 439/502 |
| 2015/0163950 | A1* | 6/2015 | Sechrist | H01R 13/514 361/788 |
| 2016/0064119 | A1* | 3/2016 | Grant | H01B 11/1025 439/656 |
| 2017/0346234 | A1 | 11/2017 | Girard, Jr. | |
| 2019/0267732 | A1* | 8/2019 | Buck | H01R 13/6471 |
| 2019/0288457 | A1* | 9/2019 | Champion | H01R 12/62 |

* cited by examiner

CABLE CONNECTOR AND CABLE CONNECTOR ASSEMBLY FOR AN ELECTRICAL SYSTEM

CROSS REFERENCE TO RELATED APPLICATIONS

This application claims benefit to U.S. Provisional Application No. 62/793,539, filed Jan. 17, 2019, titled "CABLE CONNECTOR AND CABLE CONNECTOR ASSEMBLY FOR AN ELECTRICAL SYSTEM", the subject matter of which is herein incorporated by reference in its entirety.

BACKGROUND OF THE INVENTION

The subject matter herein relates generally to cable connector assemblies for an electronic system.

The ongoing trend toward smaller, lighter, and higher performance electrical components and higher density electrical circuits has led to the development of printed circuit boards having socket connectors that receive electronic packages. Socket connectors allow for a separable connection of an electronic package, such as an integrated circuit or a computer processor, to the circuit board rather than connection by contacts or pins soldered in plated holes going through the circuit board. Socket connectors may allow for an increased component density on a circuit board, thereby saving space on the circuit board.

A socket connector may include a substrate with terminals on one side of the substrate and an array of conductive solder elements, such as a ball grid array (BGA) or a land grid array (LGA), on the opposite side. The terminals engage contacts on the electronic package and the solder elements are affixed to conductive pads on a host circuit board, such as a mother board, to electrically join the electronic package with the host circuit board. Conventional architecture provides the socket connector between the electronic package and the host circuit board. The routing of the circuits between the electronic package and the host circuit board all occur through the socket connector. The footprint of the socket connector with the host circuit board and the electronic package needs to be large enough to accommodate all of the electrical paths, such as the high-speed paths, the low speed paths, the ground paths and the power paths. Additionally, the electrical performance of the electronic system is reduced by having multiple electrical interfaces between the electronic package and the host circuit board. Furthermore, signaling is routed along the host circuit board to another electrical component mounted remotely on the host circuit board through the traces of the host circuit board, which may be relatively long, leading to signal degradation along the long paths between the electronic package and the other electrical component. Conventional systems are struggling with meeting signal and power output from the electronic package because there is a need for smaller size and higher number of conductors while maintaining good electrical performance and conventional electronic packages have a limited amount of surface area for the conductors.

A need remains for a high-speed electrical system having improved electrical performance.

BRIEF DESCRIPTION OF THE INVENTION

In one embodiment, a cable connector is provided including a twin-axial cable having a first conductor and a second conductor within a core of the cable. The cable connector includes a first signal contact including a cable terminal and a substrate terminal. The cable terminal is terminated to the first conductor of the cable and the substrate terminal is configured to be terminated to a substrate. The cable terminal is generally perpendicular to the substrate terminal. The cable connector includes a second signal contact including a cable terminal and a substrate terminal. The cable terminal is terminated to the second conductor of the cable and the substrate terminal is configured to be terminated to the substrate. The cable terminal being generally perpendicular to the substrate terminal. The cable connector includes a contact holder having a body encasing portions of the first and second signal contacts. The contact holder has a front and a rear, and a top and a bottom. The cable terminals are arranged proximate to the rear for termination to the cable. The cable extends from the rear of the contact holder. The substrate terminals are exposed at the bottom for termination to the substrate.

In another embodiment, a cable connector assembly is provided including cable connectors arranged side-by-side in a cable connector stack. Each cable connector includes a twin-axial cable having a first conductor and a second conductor within a core of the cable. Each cable connector includes first and second signal contacts terminated to the first and second cable conductors, respectively, and each cable connector includes a contact holder having a body holding the first and second signal contacts. The contact holder has a front, a rear, a top, and a bottom. The first and second contacts have cable terminals arranged proximate to the rear for termination to the first and second cable conductors. The first and second contacts have substrate terminals exposed at the bottom for termination to a substrate. Each cable connector includes a ground shield being electrically grounded to the cable shield. The cable connector assembly includes a ground clip having a clip plate extending along the top of each contact holder to hold the cable connectors in the cable connector stack with the ground shields arranged between the contact holders of adjacent cable conductors to provide electrical shielding between adjacent cable connectors. The ground clip is electrically connected to each of the ground shields to electrically common each of the cable connectors.

In another embodiment, an electronic system is provided including a substrate having substrate contacts and an electrical component mounted to an upper surface of the substrate. A cable connector assembly is coupled to the upper surface of the substrate. The cable connector assembly includes cable connectors arranged side-by-side in a cable connector stack. Each cable connector includes a twin-axial cable having a first conductor and a second conductor within a core of the cable. Each cable connector includes first and second signal contacts terminated to the first and second cable conductors, respectively, and each cable connector includes a contact holder having a body holding the first and second signal contacts. The contact holder has a front, a rear, a top, and a bottom. The first and second contacts have cable terminals arranged proximate to the rear for termination to the first and second cable conductors. The first and second contacts have substrate terminals exposed at the bottom for termination to a substrate. Each cable connector includes a ground shield being electrically grounded to the cable shield. The cable connector assembly includes a ground clip having a clip plate extending along the top of each contact holder to hold the cable connectors in the cable connector stack with the ground shields arranged between the contact holders of adjacent cable conductors to provide electrical shielding between adjacent cable connectors. The ground clip is electrically connected to each of the ground shields to electrically common each of the cable connectors.

DETAILED DESCRIPTION OF THE INVENTION

Figure 1:
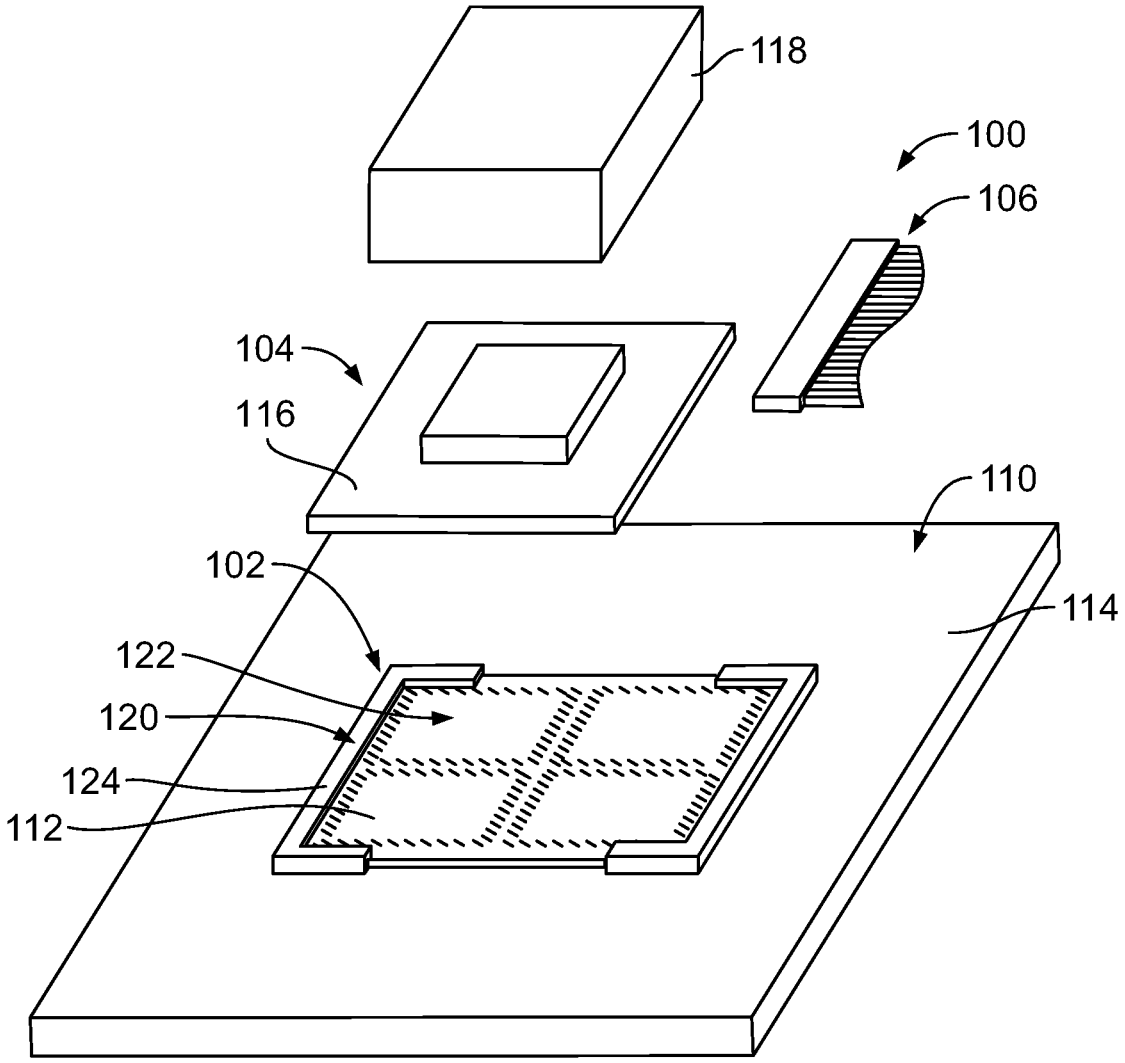
FIG. 1 is an exploded view of an electronic system in accordance with an exemplary embodiment.

FIG. 1 is an exploded view of an electronic system 100 in accordance with an exemplary embodiment. The electronic system 100 includes a socket assembly 102 electrically connected to a host circuit board 110 and an electronic package 104, such as an integrated circuit. The electronic system 100 includes a cable connector assembly 106. The cable connector assembly 106 includes a plurality of high-speed cables that are electrically connected to the electronic package 104. The cable connector assembly 106 may be directly connected to the socket assembly 102 in various embodiments. The cable connector assembly 106 may be directly connected to the electronic package 104 in various embodiments. The cable connector assembly 106 may be directly connected to the host circuit board 110 in various embodiments.

The socket assembly 102 electrically connects the electronic package 104 with the host circuit board 110. In an exemplary embodiment, the electronic package 104 is coupled to the top of the socket assembly 102 and the host circuit board 110 is coupled to the bottom of the socket assembly 102. In the illustrated embodiment, the cable connector assembly 106 is coupled directly to the electronic package 104, such as to the top of the electronic package 104 and/or the bottom of the electronic package 104. In other various embodiments, the cable connector assembly 106 is coupled to the host circuit board 110 and electrically connected to the electronic package 104 through the socket assembly 102, which is also coupled to the host circuit board 110. The electronic system 100 allows connection of the cable connector assembly 106 to one of the other components, such as the electronic package 104 or the socket assembly 102, to increase performance and design efficiency.

In various embodiments, multiple cable connector assemblies 106 are provided, such as coupled to multiple sides of the electronic package 104 to increase density of the electronic system 100 and shorten electrical paths of the electronic system 100. The arrangement may reduce the number of electrical interfaces along the signal paths to enhance electrical performance of the electronic system 100. For example, high speed data signals may be transferred directly from the electronic package 104 to the cable connector assembly 106 rather than being first routed through the socket assembly 102 and/or the host circuit board 110. In various embodiments, the cable connector assemblies 106 provide high speed electrical paths, such as through differential signaling through the cables of the cable connector assemblies 106. Other electrical paths, such as low speed electrical paths and power electrical paths, are routed between the electronic package 104 and the host circuit board 110 through other interfaces, such as the interfaces with the socket assembly 102. For example, the interfaces may include a ball grid array (BGA) having solder balls, such as soldered between the host circuit board 110 and the socket assembly 102 or a land grid array (LGA) of contacts, such as between the socket assembly 102 and the electronic package 104. Optionally, the electrical paths between the host circuit board 110 and the socket assembly 102 and/or between the socket assembly 102 and the electronic package 104 may include high speed electrical paths.

In an exemplary embodiment, the socket assembly 102 includes a socket substrate 112 having socket conductors, such as socket contacts, solder balls, and the like, which provide electrical paths through the socket substrate 112. In an exemplary embodiment, the socket substrate 112 may be a molded housing holding the socket conductors. In other various embodiments, the socket substrate 112 may be a printed circuit board having circuits, pads, traces, vias, and the like. The socket substrate conductors are electrically connected to the electronic package 104 using contacts, pins, solder balls, conductive elastomeric columns, or other intervening conductive elements. The socket substrate conductors may be electrically connected to the host circuit board 110 using contacts, pins, solder balls, conductive elastomeric columns, or other intervening conductive elements. The cable connector assembly 106 may be terminated directly to the socket substrate 112.

In an exemplary embodiment, the host circuit board 110 includes a host substrate 114 having substrate conductors that provide electrical paths through and along one or more layers of the host substrate 114. The host substrate 114 may be a printed circuit board and the host substrate conductors may be circuits, pads, traces, vias, and the like of the printed circuit board. The host substrate conductors may be electrically connected to the socket substrate 112 using contacts, pins, solder balls, conductive elastomeric columns, or other intervening conductive elements. The cable connector assembly 106 may be terminated directly to the host substrate 114, such as by a press fit connection, a solder connection, a compression connection, and the like.

In an exemplary embodiment, the electronic package 104 includes a package substrate 116 having package substrate conductors that provide electrical paths through and along one or more layers of the package substrate 116. The package substrate 116 may be a printed circuit board and the package substrate conductors may be circuits, pads, traces, vias, and the like of the printed circuit board. The package substrate conductors may be electrically connected to the socket substrate 112 using contacts, pins, solder balls, conductive elastomeric columns, or other intervening conductive elements. In an exemplary embodiment, such as in the illustrated embodiment, the cable connector assembly 106 may be terminated directly to the package substrate 116, such as by a press fit connection, a solder connection, a compression connection, and the like.

In an exemplary embodiment, the electronic system 100 includes a heat sink 118 for dissipating heat from one or more of the components of the electronic system 100, such as from the electronic package 104. In the illustrated embodiment, the heat sink 118 is provided above the electronic package 104. The socket assembly 102 and the electronic package 104 are provided in the space between the heat sink 118 and the host circuit board 110. In an exemplary embodiment, the cable connector assemblies 106 are coupled to the electronic package 104 and/or the socket assembly 102 and/or the host circuit board 110 in the space between the heat sink 118 and the host circuit board 110. For example, the cable connector assemblies 106 are low profile and able to fit in the small space close to the electronic package 104 to reduce signal path lengths between the cable connector assemblies 106 and the electronic package 104.

In an exemplary embodiment, the socket assembly 102 includes a socket frame 120 on the top of the socket substrate 112 that receives the electronic package 104. For example, the socket frame 120 may form a socket opening 122 that receives the electronic package 104. The socket frame 120 may be used to align the electronic package 104 with the socket substrate 112 for mating the electronic package 104 with the socket substrate 112. For example, frame walls 124 of the socket frame 120 may surround the socket opening 122 to receives the electronic package 104 and the frame walls 124 may orient and align the electronic package 104 in one or more directions. In an exemplary embodiment, the socket frame 120 may limit or stop compression of a compressible interface of the socket assembly 102 to prevent damage to various components. The socket frame 120 may hold various components together for mounting to other components.

Figure 2:
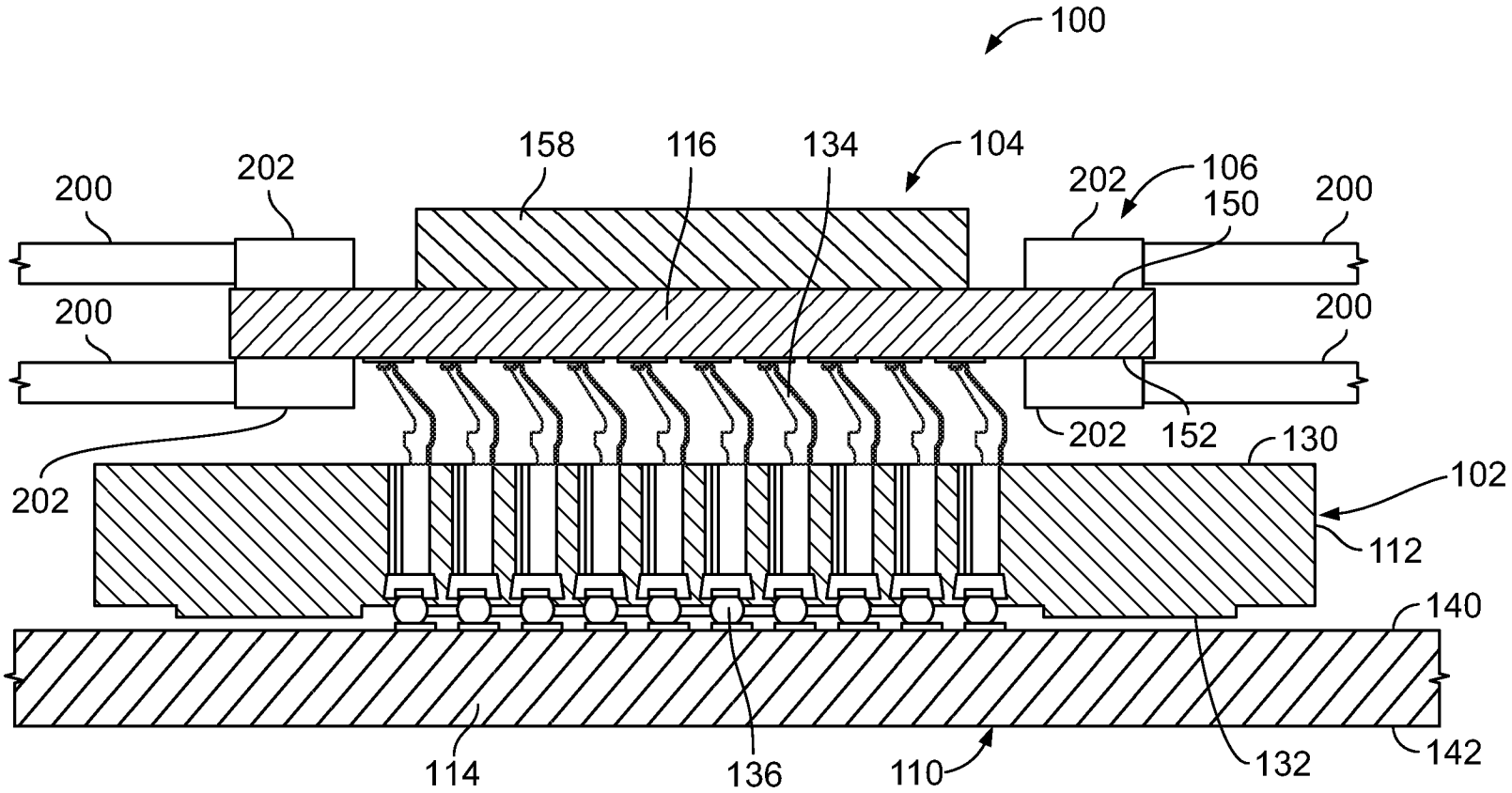
FIG. 2 is a cross-sectional view of the electronic system formed in accordance with an exemplary embodiment.

FIG. 2 is a cross-sectional view of the electronic system 100 formed in accordance with an exemplary embodiment. The socket assembly 102 includes the socket substrate 112 having an upper surface 130 and a lower surface 132. The socket substrate 112 includes socket contacts 134 held by the socket substrate 112. In the illustrated embodiment, the socket substrate 112 is a housing or frame holding the socket contacts 134. In an exemplary embodiment, the socket contacts 134 are provided on the upper surface 130 and on the lower surface 132. The electronic package 104 is terminated to the socket contacts 134 on the upper surface 130. In the illustrate embodiment, the socket contacts 134 are compressible contacts having deflectable spring beams. The socket contacts 134 define a separable interface for mating with the electronic package 104. The socket contacts 134 on the lower surface 132 are terminated to the host circuit board 110, such as using solder balls 136.

The host circuit board 110 includes the host substrate 114 having an upper surface 140 and a lower surface 142. The host circuit board 110 includes contacts defined by circuits of the host substrate 114. The contacts may include pads, traces, vias, or other types of contacts. In an exemplary embodiment, the socket assembly 102 is terminated to the contacts on the upper surface 140. In various embodiments, the cable connector assemblies 106 may be coupled to the host substrate 114, such as to the upper surface 140 and/or the lower surface 142.

In an exemplary embodiment, the electronic package 104 is an integrated circuit component, such as an application-specific integrated circuit (ASIC); however, other types of electronic packages may be used in alternative embodiments, such as chips, processors, memory devices and the like. The electronic package 104 includes the package substrate 116 having an upper surface 150 and a lower surface 152. The electronic package 104 includes package contacts defined by circuits of the package substrate 116. In an exemplary embodiment, the package contacts are provided on the lower surface 152 and/or the upper surface 150. The package contacts may include pads, traces, vias, or other types of contacts.

In the illustrated embodiment, the electronic package 104 includes an electronic component 158, such as a chip, on the upper surface 150. The electronic component 158 may be electrically connected to the package contacts through traces or circuits of the package substrate 116. In the illustrated embodiment, the electronic component 158 is approximately centered on the package substrate 116.

In an exemplary embodiment, the cable connector assemblies 106 are coupled to the package substrate 116 proximate to the electronic component 158 and are electrically connected to the electronic component 158 by the package contacts. For example, the cable connector assemblies 106 may be terminated to the upper surface 150 and/or the lower surface 152. In an exemplary embodiment, the cable connector assembly 106 includes a plurality of cables 200 extending away from the electronic package 104. Any number of cables 200 may be provided, depending on the particular application. For example, a greater number of cables 200 may be utilized in higher density applications to provide a greater number of electrical paths to and from the electronic package 104. Optionally, the cables 200 may be shielded cables providing electrical shielding for the electrical path. Optionally, the cables 200 may be differential pair cables where each cable 200 includes a pair of cable conductors.

In an exemplary embodiment, each cable connector assembly 106 includes a plurality of cable connectors 202, each terminated at an end of the corresponding cable 200. The cable connectors 202 are terminated to the package substrate 116. For example, upper cable connectors 202 may be terminated to the upper surface 150 of the package substrate 116 and lower cable connectors 202 may be terminated to the lower surface 152 of the package substrate 116. In an exemplary embodiment, the cable connector assemblies 106 may be routed from different sides of the package substrate 116. For example, the cable connector assemblies 106 may be terminated to all four sides of the package substrate 116 extending in four different directions (e.g., north/south/east/west). However, in other various embodiments, fewer cable connector assemblies 106 may be provided, such as cable connector assemblies 106 extending from two opposite sides in opposing directions (e.g., north/south). The cables 200 may extend generally horizontally, such as generally in plane with the electronic package 104 and/or parallel to the host circuit board 110. Optionally, different cable connector assemblies 106 may be routed to different components. The cables 200 of the various cable connector assemblies 106 may be bound together for cable management, such as using cable straps, clips, ties and the like.

Figure 3:
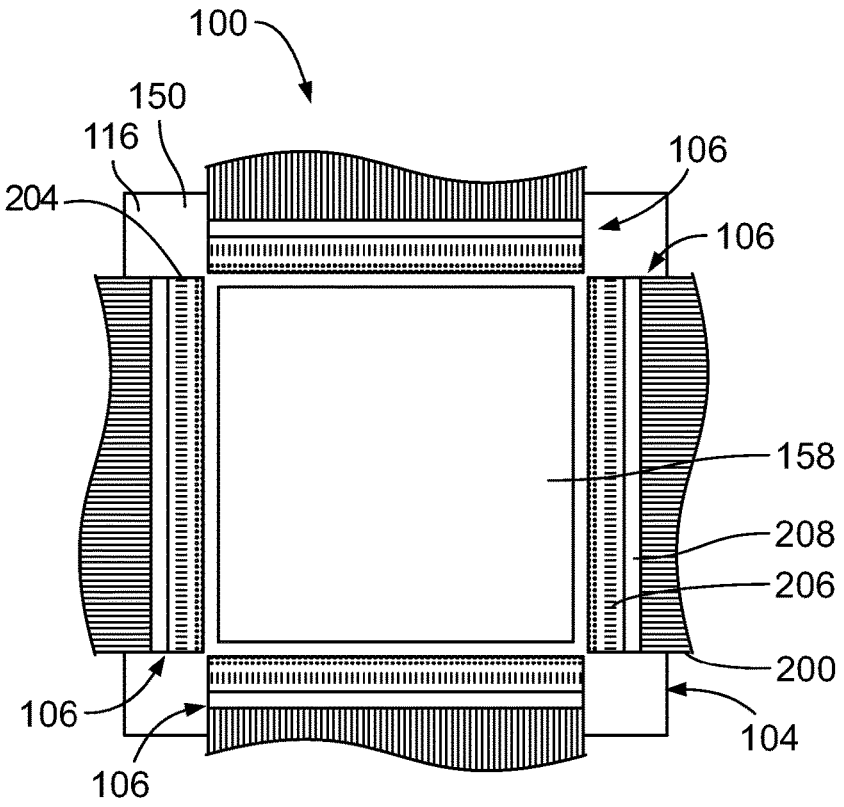
FIG. 3 is a top view of a portion of the electronic system in accordance with an exemplary embodiment.
Figure 4:
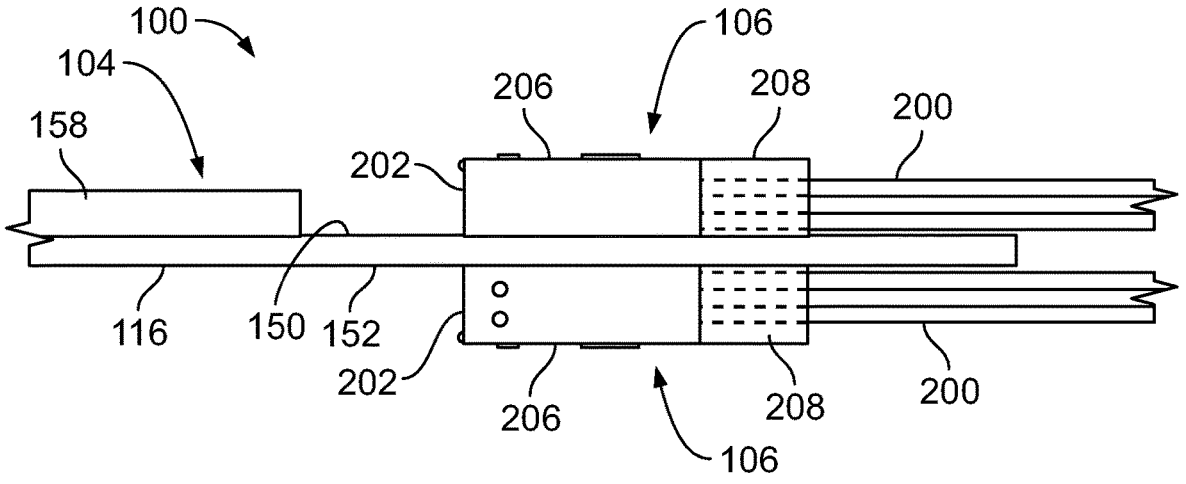
FIG. 4 is a side view of a portion of the electronic system in accordance with an exemplary embodiment.

FIG. 3 is a top view of a portion of the electronic system 100 in accordance with an exemplary embodiment. FIG. 4 is a side view of a portion of the electronic system 100 in accordance with an exemplary embodiment. FIGS. 3 and 4 illustrate the cable connector assemblies 106 coupled to the package substrate 116; however, the cable connector assemblies 106 may be coupled to other substrates in alternative embodiments. The cable connector assemblies 106 may be used in another type of electronic system that includes components other than an electronic package 104.

Each cable connector assembly 106 includes a plurality of the cable connectors 202 arranged side-by-side in a cable connector stack 204. The cables 200 extend from the corresponding cable connectors 202. In an exemplary embodiment, a ground clip 206 extends along the cable connectors 202 to hold the cable connectors 202 in the cable connector stack 204. The ground clip 206 is configured to be electrically coupled to each of the cable connectors 202 to electrically common the cable connectors 202. The ground clip 206 is configured to be electrically coupled to cable shields of the cables 200 to electrically common each of the cables 200.

In an exemplary embodiment, the cable connector assembly 106 includes a cable holder 208 coupled to each of the cables 200. The ground clip 206 may be coupled to the cable holder 208. The cable holder 208 physically ties together all of the cables 200 within the cable connector assembly 106. The cable holder 208 may provide strain relief for the cables 200. In an exemplary embodiment, the cable holder 208 is formed in place on the cables 200. For example, the cable holder 208 may be overmolded over the cables 200 after the cable connectors 202 are stacked together in the cable connector stack 204. For example, the cable holder 208 may be molded around the cables 200. The cable holder 208 may be molded around the ground clip 206.

During assembly, each cable connector assembly 106 is preassembled such that the cables 200 and cable connectors 202 may be coupled to the package substrate 116 as a unit. In an exemplary embodiment, the cable connector assemblies 106 are coupled to the package substrate 116 proximate to the electronic component 158. In the illustrated embodiment, the cable connector assemblies 106 are provided on all four sides of the electronic component 158. In an exemplary embodiment, the cable connector assemblies 106 are mounted to the upper surface 150 and the lower surface 152 of the package substrate 116. Optionally, the upper cable connector assembly 106 mounted to the upper surface 150 may be offset with respect to the lower cable connector assembly 106 mounted to the lower surface 152, such as for easier conductor routing through the package substrate 116 (for example, the traces and/or vias may be offset at the upper surface 150 and the lower surface 152).

Figure 5:
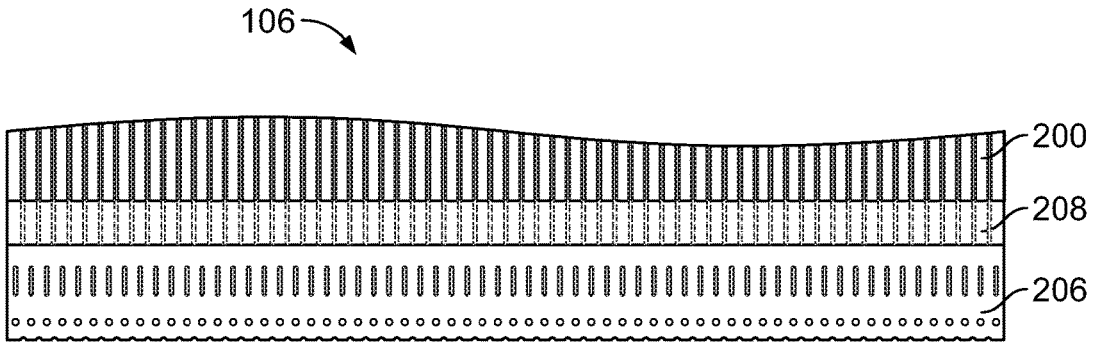
FIG. 5 is a top view of a cable connector assembly of the electronic system in accordance with an exemplary embodiment.
Figure 6:
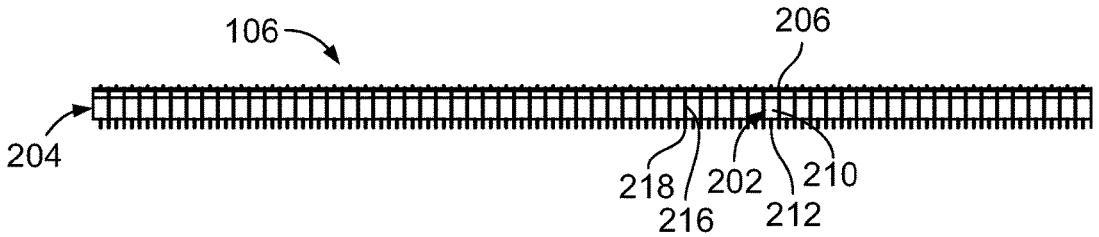
FIG. 6 is a front view of the cable connector assembly in accordance with an exemplary embodiment.
Figure 7:
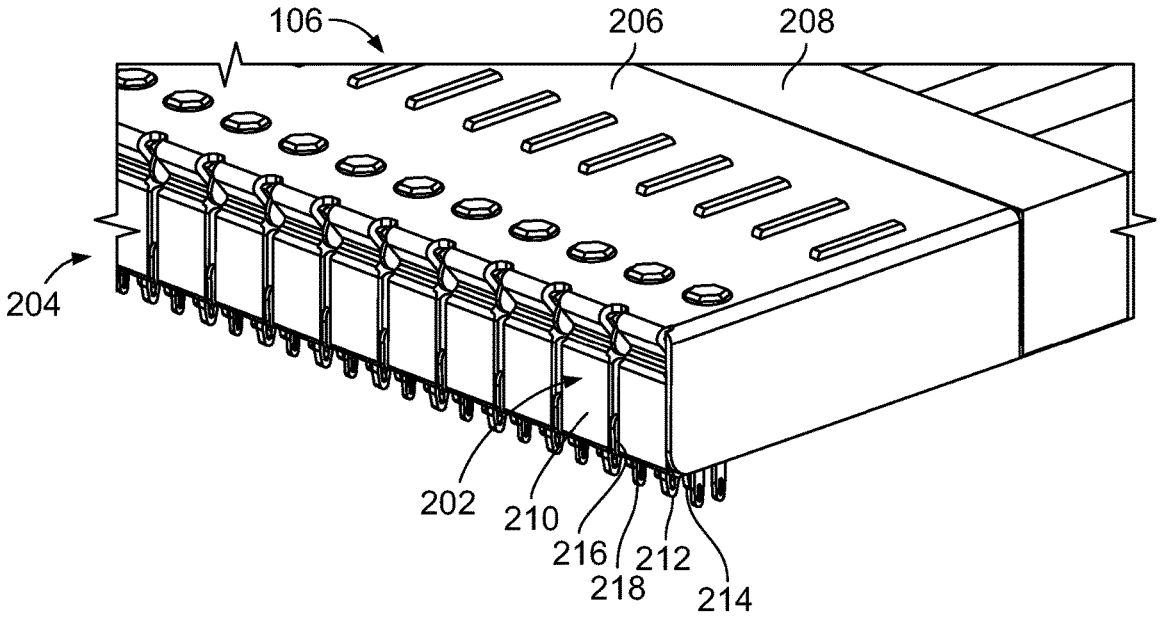
FIG. 7 is a top perspective view of a portion of the cable connector assembly in accordance with an exemplary embodiment.

FIG. 5 is a top view of the cable connector assembly 106 in accordance with an exemplary embodiment. FIG. 6 is a front view of the cable connector assembly 106 in accordance with an exemplary embodiment. FIG. 7 is a top perspective view of a portion of the cable connector assembly 106 in accordance with an exemplary embodiment. The cable connector assembly 106 includes the ground clip 206 holding the cable connectors 202 in the cable connector stack 204. The cables 200 extend rearward from the cable connectors 202. Each cable connector 202 includes a contact holder 210 holding a first signal contact 212 and a second signal contact 214. The first and second signal contacts 212, 214 are configured to be terminated to corresponding conductors of the cable 200. In an exemplary embodiment, the signal contacts 212, 214 are configured to be terminated to the package substrate 116. For example, the signal contacts 212, 214 may be press-fit to the package substrate 116, soldered to the package substrate 116 or terminated by other means.

In an exemplary embodiment, each cable connector 202 includes a ground shield 216 coupled to the contact holder 210. The ground shield 216 is configured to be electrically connected to the cable 200, such as to a cable shield of the cable 200. The ground shield 216 is configured to be electrically connected to the ground clip 206 to provide an electrical path between the cable 200 and the ground clip 206. The ground shield 216 provides electrical shielding between the adjacent cable connectors 202. The ground shield 216 includes one or more ground contacts 218 extending therefrom configured to be electrically connected to the package substrate 116.

Figure 8:
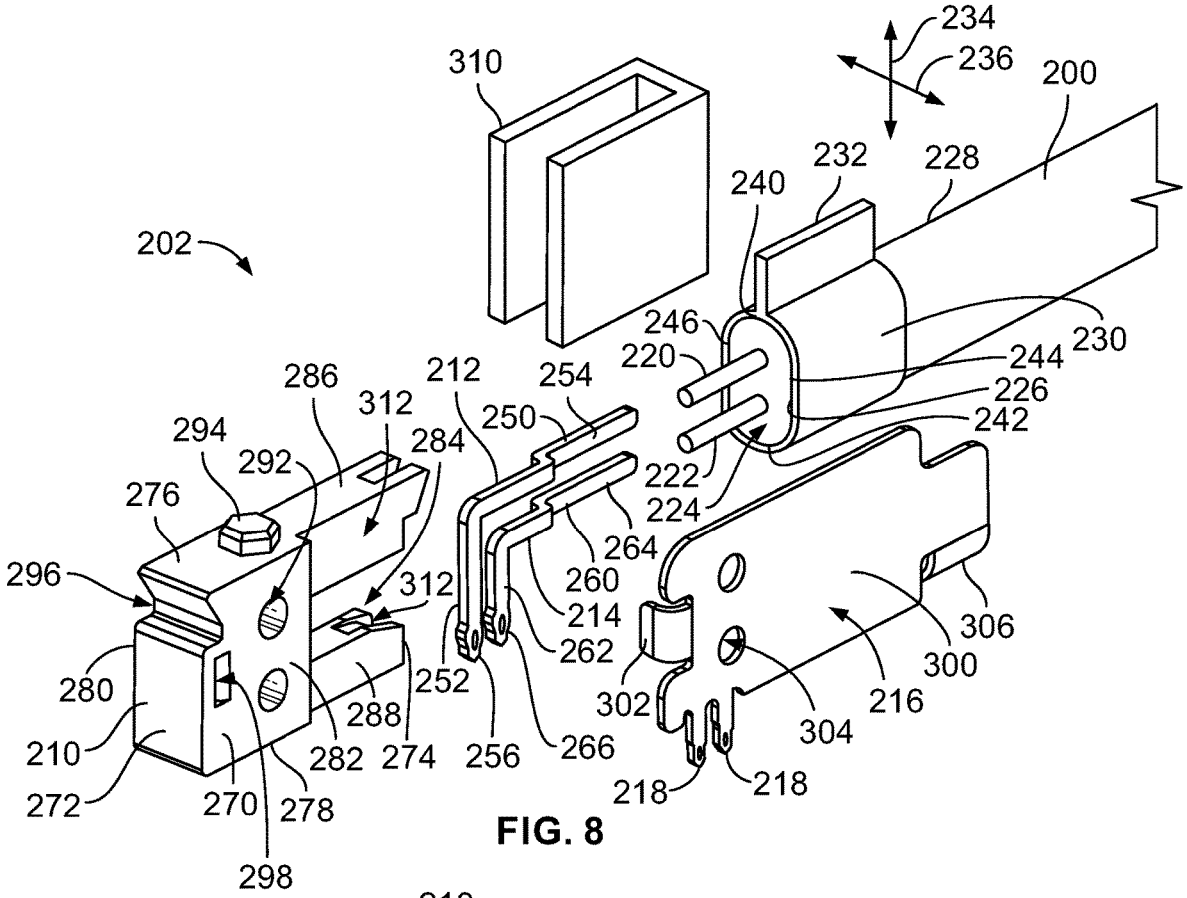
FIG. 8 is an exploded view of a cable and a cable connector of the cable connector assembly in accordance with an exemplary embodiment.

FIG. 8 is an exploded view of the cable 200 and cable connector 202 in accordance with an exemplary embodiment. In an exemplary embodiment, the cable 200 is a twin-axial cable having a first conductor 220 and a second conductor 222 within a core 224 of the cable 200. The conductors 220, 222 are configured to be terminated to the first and second signal contacts 212, 214, respectively. For example, the conductors 220, 222 may extend forward from the insulator holding the conductors 220, 222 for termination to the signal contacts 212, 214. The cable 200 includes a cable shield 226 surrounding the core 224 and providing electrical shielding for the conductors 220, 222 along a longitudinal axis of the cable 200. The cable 200 includes a jacket 228 surrounding the cable shield 226.

In an exemplary embodiment, a ferrule 230 is coupled to an end of the cable 200. The ferrule 230 may be crimped onto the cable 200. In an exemplary embodiment, the ferrule 230 is electrically connected to the cable shield 226. In various embodiments, the ferrule 230 includes a ferrule tab 232 extending from one side of the ferrule 230. The ferrule tab 232 is used to align the cable 200 with the cable connector 202. In an exemplary embodiment, the ferrule tab 232 is configured to be electrically connected to the ground clip 206 (shown in FIG. 7).

In an exemplary embodiment, the core 224 of the cable 200 is elongated with the first and second conductors 220, 222 being provided on opposite sides of the longitudinal axis. The core 224 is elongated in a lateral direction 234. The core 224 is narrow in a transverse direction 236 compared to the lateral direction 234. For example, the core 224 may be oval-shaped being elongated in the lateral direction 234 and narrow in the transverse direction 236. In an exemplary embodiment, to reduce a footprint of the cable 200 on the package substrate 116, the cable 200 is configured to be arranged on end such that the cable 200 is tall and narrow. For example, the cable 200 may include a top 240, a bottom 242, a first side 244, and a second side 246. A height of the cable 200 between the top 240 and the bottom 242 is greater than a width of the cable 200 between the sides 244, 246. In an exemplary embodiment, the ferrule tab 232 extends from the top 240.

The first signal contact 212 includes a cable terminal 250 and a substrate terminal 252. The cable terminal 250 is integral with the substrate terminal 252. For example, the first signal contact 212 may be a stamped and formed contact with the cable terminal 250 and the substrate terminal 252 to being stamped from a common sheet of metal. In the illustrated embodiment, the substrate terminal 252 is oriented generally perpendicular with respect to the cable terminal 250. Other orientations are possible in alternative embodiments.

The cable terminal 250 includes a pad 254 configured to be terminated to the first conductor 220. For example, the pad 254 may be a weld pad having a surface to which the first conductor 220 is welded. The cable terminal 250 may include other connection means other than the pad 254, such as a crimp barrel, an insulation displacement contact, and the like.

The substrate terminal 252 includes a tail 256 configured to be terminated to the package substrate 116. For example, in the illustrated embodiment, the tail 256 includes a compliant pin at the end of the signal contact 212. The compliant pin is configured to be press-fit into the package substrate 116. The substrate terminal 252 may include other connection means other than the compliant pin in alternative embodiments. For example, the tail 256 may be a solder tail configured to be soldered to the package substrate 116.

The second signal contact 214 includes a cable terminal 260 and a substrate terminal 262. The cable terminal 260 is integral with the substrate terminal 262. For example, the second signal contact 214 may be a stamped and formed contact with the cable terminal 260 and the substrate terminal 262 to being stamped from a common sheet of metal. In the illustrated embodiment, the substrate terminal 262 is oriented generally perpendicular with respect to the cable terminal 260. Other orientations are possible in alternative embodiments.

The cable terminal 260 includes a pad 264 configured to be terminated to the second conductor 222. For example, the pad 264 may be a weld pad having a surface to which the second conductor 222 is welded. The cable terminal 260 may include other connection means other than the pad 264, such as a crimp barrel, an insulation displacement contact, and the like.

The substrate terminal 262 includes a tail 266 configured to be terminated to the package substrate 116. For example, in the illustrated embodiment, the tail 266 includes a compliant pin at the end of the signal contact 214. The compliant pin is configured to be press-fit into the package substrate 116. The substrate terminal 262 may include other connection means other than the compliant pin in alternative embodiments. For example, the tail 266 may be a solder tail configured to be soldered to the package substrate 116.

In an exemplary embodiment, the first signal contact 212 has different dimensions than the second signal contact 214. For example, the first signal contact 212 is longer than the second signal contact 214 to extend between the package substrate 116 and the corresponding conductors 220, 222. With the cable 200 elongated in the lateral direction 234, such as in a vertical orientation, the cable terminal 250 of the first signal contact 212 is located above the cable terminal 260 of the second signal contact 214. The substrate terminal 252 of the first signal contact 212 is located forward of the substrate terminal 262 of the second signal contact 214. The size, shape and orientation of the signal contacts 212, 214 accommodate the vertical stacking of the conductors 220, 222 of the cable 200 as well as offsetting of the substrate terminals 252, 262 for mating with the package substrate 116 in line with (parallel to) the longitudinal axis of the cable 200. Such an arrangement allows tighter packaging of the cables 200 and cable connectors 202 along the package substrate 116, such as compared to embodiments having the cable 200 oriented on its side rather than on its end.

The contact holder 210 includes a body 270 configured to hold the first and second signal contacts 212, 214. The contact holder 210 includes a front 272 and a rear 274. The contact holder 210 includes a top 276 and a bottom 278. The contact holder 210 includes a first side 280 and a second side 282. In an exemplary embodiment, the contact holder 210 holds the signal contacts 212, 214 such that the cable terminals 250, 260 are arranged proximate to the rear 274 and the substrate terminals 252, 262 are arranged proximate to the front 272. The substrate terminals 252, 262 may extend from the bottom 278 for termination to the package substrate 116. Optionally, the signal contacts 212, 214 may be approximately centered between the first and second sides 280, 282. In various embodiments, the signal contacts 212, 214 may be overmolded to encase the signal contacts 212, 214 in the body 270. Alternatively, the signal contacts 212, 214 may be loaded into the preformed body 270 of the contact holder 210.

In an embodiment, the body 270 includes a terminating pocket 284 open at the rear 274. The terminating pocket 284 is defined by an upper beam 286 above the terminating pocket 284 and a lower beam 288 below the terminating pocket 284. The cable terminals 250, 260 are configured to be arranged in the terminating pocket 284 for terminating to the conductors 220, 222 of the cable 200. For example, the cable may be attached to the rear 274 of the cable holder 208 (shown in FIG. 7) such that the conductors 220, 222 extend into the terminating pocket 284 for termination to the cable terminals 250, 260.

In an exemplary embodiment, the contact holder 210 includes stacking features configured to be coupled to adjacent cable connectors 202 for stacking the cable connectors 202 in the cable connector stack 204 (shown in FIG. 7). For example, the contact holder 210 includes one or more stacking alignment bosses 290 (shown in FIG. 12) extending from the first side 280 and one or more stacking alignment holes 292 on the second side 282 configured to receive stacking alignment bosses 290 of an adjacent cable connector 202 stacked at the second side 282 of the contact holder 210. The stacking alignment bosses 290 and the stacking alignment holes 292 provide vertical alignment and horizontal alignment (along the longitudinal axis of the cable 200) of the stacked cable connectors 202.

In an exemplary embodiment, the contact holder 210 includes a clip alignment feature 294 configured to engage the ground clip 206 (shown in FIG. 7). In the illustrated embodiment, the clip alignment feature 294 is a a protrusion extending from the top 276. Other types of clip alignment features 294 may be provided in alternative embodiments, such as a slot or groove formed in the top 276. The clip alignment feature 294 aligns the cable connector 202 relative to the ground clip 206. In an exemplary embodiment, the contact holder 210 includes a clip pocket 296 in the front 272 that receives a portion of the ground clip 206. The ground clip 206 may be snapped onto the contact holder 210 at the clip pocket 296.

In an exemplary embodiment, the contact holder 210 includes a shield retention slot 298 that receives a portion of the ground shield 216 to secure the ground shield 216 to the contact holder 210. In the illustrated embodiment, the shield retention slot 298 is open at the second side 282 for receiving the ground shield 216. The shield retention slot 298 may be provided at other locations in alternative embodiments.

In an exemplary embodiment, the ground shield 216 includes a plate 300 sized and shaped to fit along the side of the contact holder 210. For example, the plate 300 may be coupled to the second side 282 of the contact holder 210. The ground shield 216 includes a retention tab 302 extending from the plate 300. The retention tab 302 is configured to be received in the shield retention slot 298 of the contact holder 210. The retention tab 302 may be held in the shield retention slot 298 by an interference fit. Optionally, the retention tab 302 may include barbs or other features to secure the ground shield 216 to the contact holder 210.

The ground contacts 218 extend from the plate 300, such as from a bottom of the plate 300 for termination to the package substrate 116. In the illustrated embodiment, the ground contacts 218 are defined by compliant pins, such as eye of the needle pins. The ground contacts 218 are configured to be press-fit into the package substrate 116. Other types of ground contacts 218 may be provided in alternative embodiments, such as solder tails configured to be soldered to the package substrate 116. In the illustrated embodiment, the ground contacts 218 are arranged in plane with the plate 300. However, the ground contacts 218 may be offset from the plate 300 in alternative embodiments.

In an exemplary embodiment, the ground shield 216 includes stacking alignment holes 304 configured to be aligned with the stacking alignment holes 292 of the contact holder 210. The stacking alignment holes 304 receive stacking alignment bosses 290 (shown in FIG. 12) of the adjacent cable connector 202 when stacking the cable connectors 202 into the cable connector stack 204. The stacking alignment holes 304 are sized and shaped similar to the stacking alignment holes 292 to receive the corresponding stacking alignment bosses 290 (shown in FIG. 12).

In an exemplary embodiment, the ground shield 216 includes a ferrule tab 306 extending from the plate 300. The ferrule tab 306 is configured to be electrically connected to the ferrule 230. The ferrule tab 306 may have a complementary shape to the ferrule 230. For example, the ferrule tab 306 may curve along one or more sides of the ferrule 230. Optionally, the ferrule tab 306 may be welded or soldered to the ferrule 230. In other various embodiments, the ferrule tab 306 may be crimped to the ferrule 230.

In an exemplary embodiment, the cable connector 202 includes a signal conductor holder 310. The signal conductor holder 310 is configured to hold the first and second signal conductors 220, 222 and/or the first and second signal contacts 212, 214. For example, the signal conductor holder 310 may be arranged at the rear 274 of the contact holder 210. The signal conductor holder 310 is manufactured from a dielectric material, such as a plastic material. In various embodiments, the signal conductor holder 310 may be formed in place on the cable 200 and/or the contact holder 210 after the signal contacts 212, 214 are terminated to the conductors 220, 222. For example, the signal conductor holder 310 may be overmolded over the signal contacts 212, 214 and/or the conductors 220, 222. The signal conductor holder 310 is formed on the back end of the contact holder 210, such as at the rear 274. The signal conductor holder 310 may be formed into the terminating pocket 284. For example, the signal conductor holder 310 may substantially or entirely fill the terminating pocket 284 around the signal conductors 220, 222 and the cable terminals 250, 260 of the signal contacts 212, 214. The signal conductor holder 310 provides strain relief at the interface between the conductors 220, 222 and the signal contacts 212, 214. In an exemplary embodiment, the contact holder 210 includes grooves or channels 312 at the rear 274 and/or at the sides 280, 282. The signal conductor holder 310 may be received in the channels 312. Optionally, the signal conductor holder 310 may be formed around a portion of the ferrule 230 and/or a portion of the cable 200, such as around the core 224 and/or the jacket 228.

Figure 9:
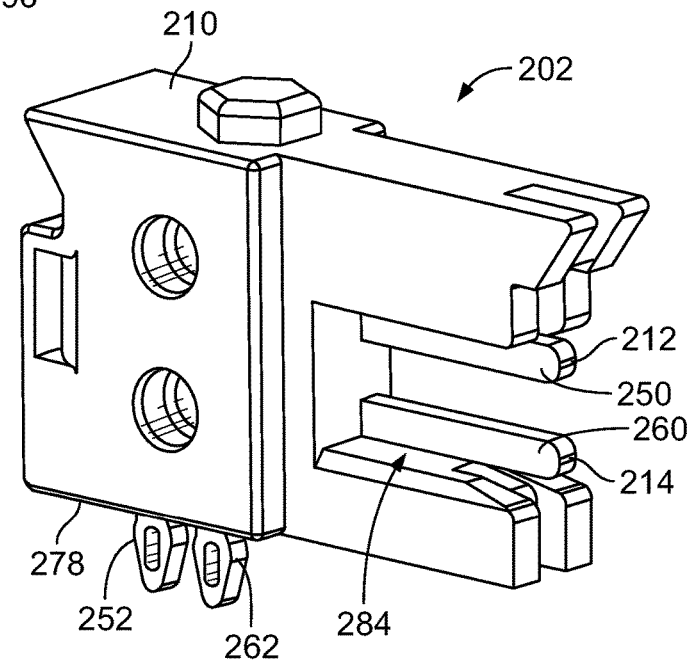
FIG. 9 is a rear perspective view of a portion of the cable connector illustrating signal contacts in a contact holder in accordance with an exemplary embodiment.

FIG. 9 is a rear perspective view of a portion of the cable connector 202 illustrating the signal contacts 212, 214 in the contact holder 210. The contact holder 210 surrounds portions of the signal contacts 212, 214 to hold the signal contacts 212, 214 relative to each other for termination to the cable 200 and the package substrate 116. For example, the contact holder 210 may be overmolded around portions of the cable terminals 250, 260 and/or portions of the substrate terminals 252, 262 (shown in FIG. 8). The ends of the cable terminals 250, 260 are exposed in the terminating pocket 284 for termination to the cable 200. The ends of the substrate terminals 252, 262 are exposed at the bottom 278 of the contact holder 210 for termination of the signal contacts 212, 214 to the package substrate 116.

Figure 10:
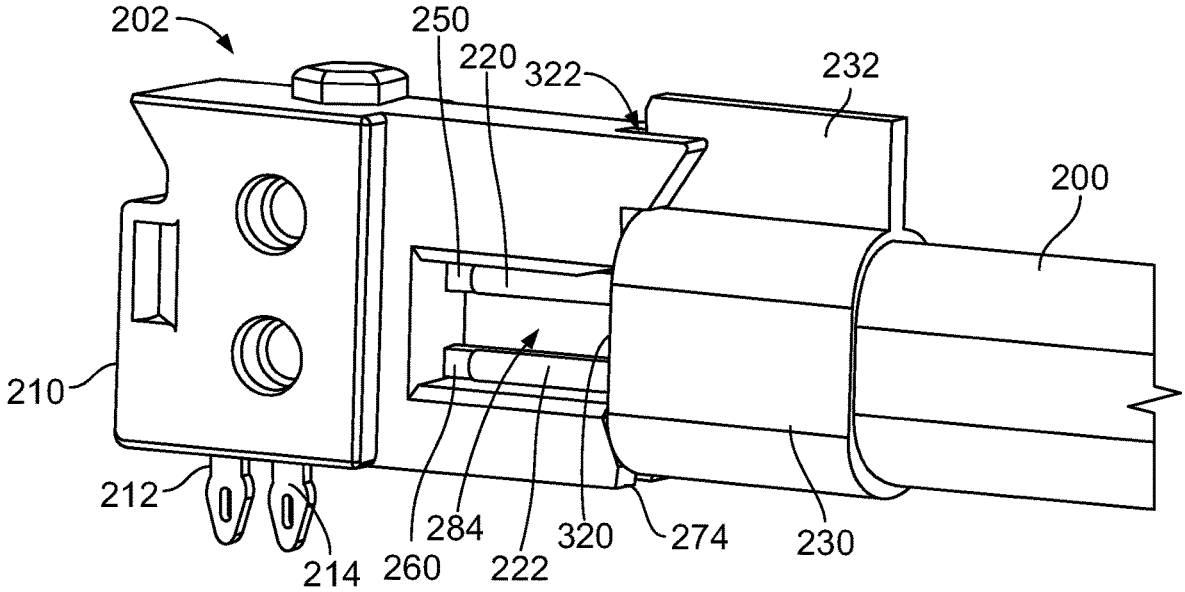
FIG. 10 is a rear perspective view of a portion of the cable connector illustrating an end of a cable coupled to the cable connector in accordance with an exemplary embodiment.

FIG. 10 is a rear perspective view of a portion of the cable connector 202 illustrating an end 320 of the cable 200 coupled to the cable connector 202. The conductors 220, 222 extend into the terminating pocket 284 along sides of the cable terminals 250, 260. The conductors 220, 222 may be welded to the cable terminals 250, 260. For example, the conductors 220, 222 may be laser welded, ultrasonic welded or resistance welded to the cable terminals 250, 260. The conductors 220, 222 may be terminated by other means in alternative embodiments, such as soldering, crimping and the like.

The end 320 of the cable 200 is coupled to the rear 274 of the contact holder 210. In an exemplary embodiment, the contact holder 210 includes a ferrule alignment slot 322 at the rear 274 that receives the ferrule tab 232 of the ferrule 230. The ferrule alignment slot 322 aligns the ferrule 230 relative to the contact holder 210. The contact holder 210 resists rotation of the cable 200 relative to the contact holder 210, such as for strain relief between the conductors 220, 222 and the cable terminals 250, 260.

In an exemplary embodiment, after the conductors 220, 222 are terminated to the signal contacts 212, 214, the signal conductor holder 310 (shown in FIG. 8) may be coupled to the cable 200 and the contact holder 210. For example, the signal conductor holder 310 may be overmolded around the end 320 of the cable 200 and the rear 274 of the contact holder 210, such as in the terminating pocket 284.

Figure 11:
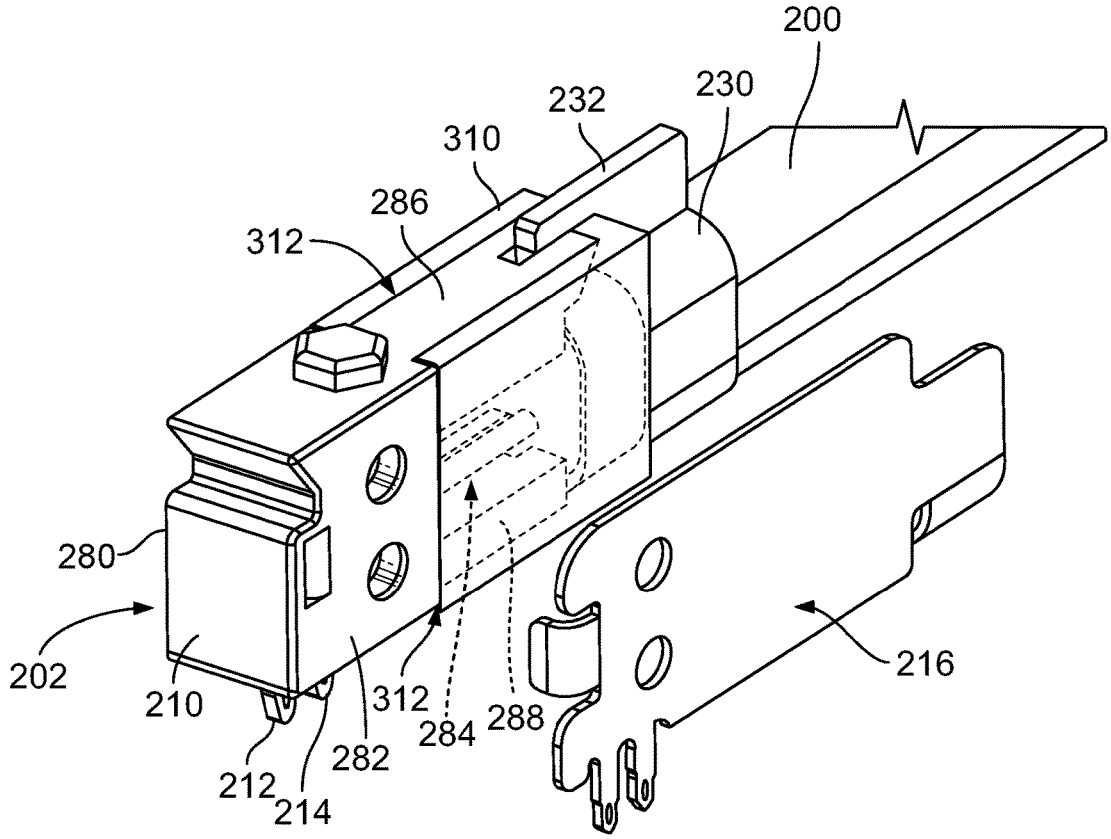
FIG. 11 is a front perspective view of a portion of the cable connector and the cable in accordance with an exemplary embodiment.

FIG. 11 is a front perspective view of a portion of the cable connector 202 and the cable 200 in accordance with an exemplary embodiment. FIG. 11 illustrates the signal conductor holder 310 applied to the cable 200 and the contact holder 210. The signal conductor holder 310 is received in the channels 312 along the sides of the upper and lower beams 286, 288. The signal conductor holder 310 is received in the terminating pocket 284 around the conductors 220, 222 (shown in FIG. 10) and the signal contacts 212, 214. The signal conductor holder 310 is coupled to the ferrule 230 and the ferrule tab 232. The signal conductor holder 310 may be formed in place to hold the cable 200 and the cable connector 202 together as a unit. After the signal conductor holder 310 is formed in place, the ground shield 216 may be coupled to the second side 282 of the contact holder 210.

Figure 12:
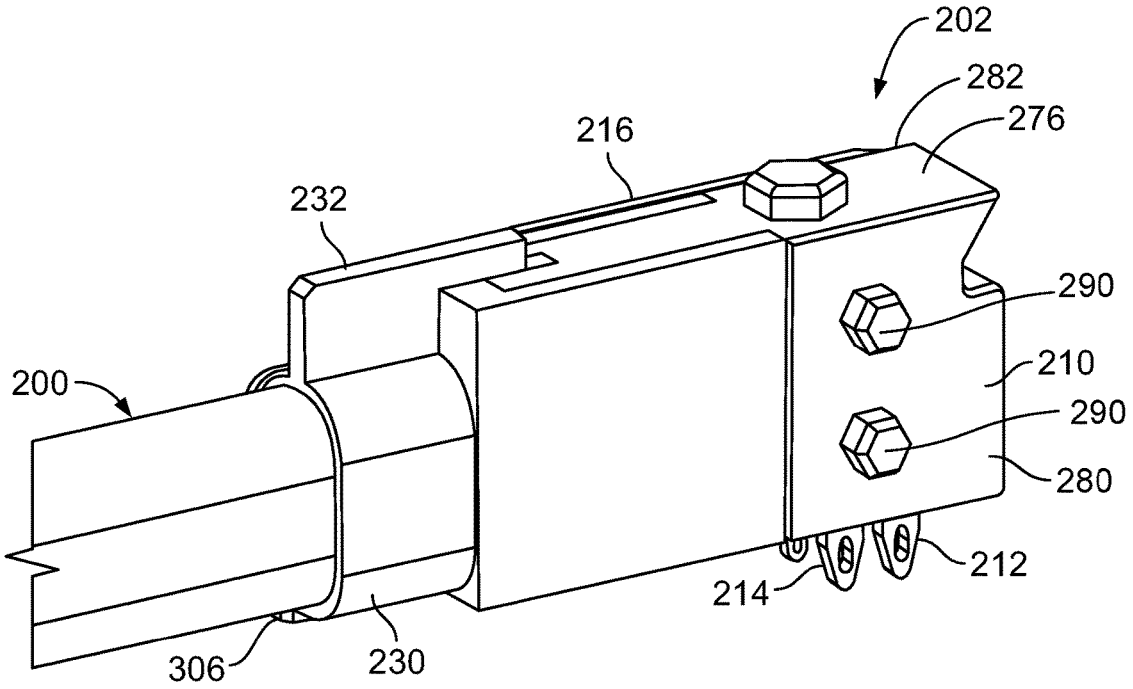
FIG. 12 is a perspective view of the cable connector and the cable in accordance with an exemplary embodiment.
Figure 13:
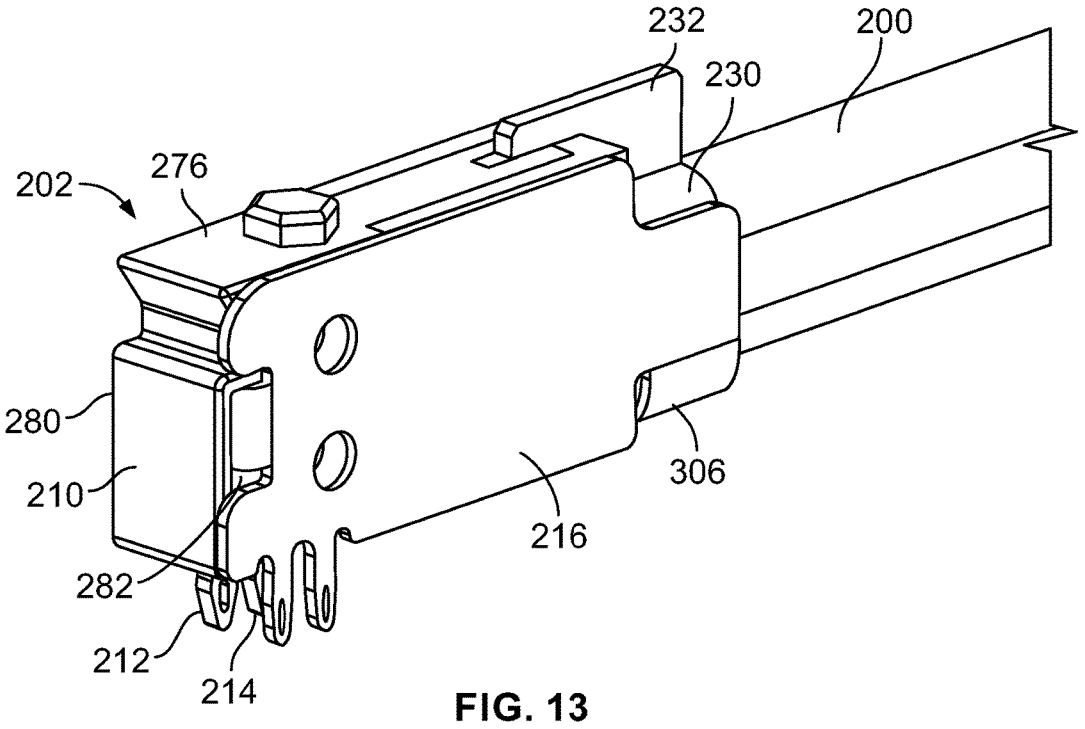
FIG. 13 is a perspective view of the cable connector and the cable in accordance with an exemplary embodiment.

FIG. 12 is a perspective view of the cable connector 202 and the cable 200 in accordance with an exemplary embodiment. FIG. 13 is a perspective view of the cable connector 202 and the cable 200 in accordance with an exemplary embodiment. The ground shield 216 is coupled to the contact holder 210 and provides electrical shielding along the second side 282 of the contact holder 210. The ground shield 216 provides electrical shielding for the signal contacts 212, 214. The ground shield 216 provides electrical shielding along the mating zone for the conductors 220, 222 and the signal contacts 212, 214. The ferrule tab 306 is electrically connected to the ferrule 230 to electrically common the ground shield 216 with the cable 200. In an exemplary embodiment, a portion of the ferrule tab 232 stand proud of the top 276 of the contact holder 210 for connection with the ground clip 206 (shown in FIG. 7).

Figure 14:
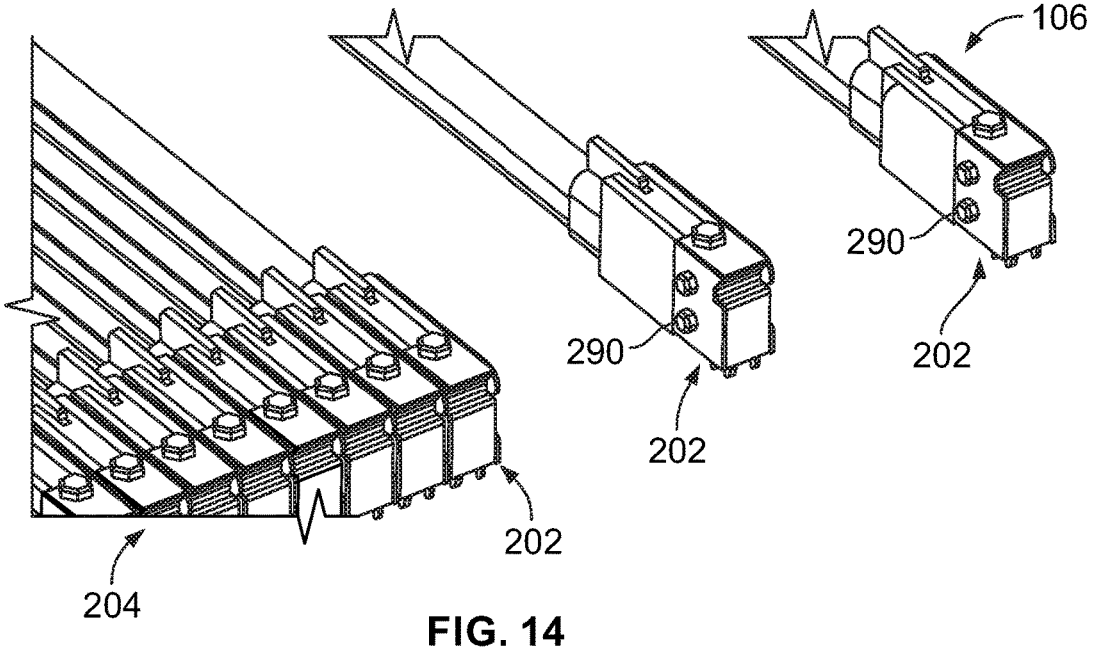
FIG. 14 is a front perspective view of a portion of the cable connector assembly illustrating a plurality of the cable connectors arranged in a cable connector stack in accordance with an exemplary embodiment.

FIG. 14 is a front perspective view of a portion of the cable connector assembly 106 illustrating a plurality of the cable connectors 202 arranged in a cable connector stack 204. The cable connectors 202 are arranged side-by-side and connected together in the cable connector stack 204. For example, the stacking alignment bosses 290 of the cable connectors 202 are received in corresponding stacking alignment holes 292 (shown in FIG. 8) of the adjacent cable connector 202 within the cable connector stack 204. The stacking alignment bosses 290 hold the relative positions of the cable connectors 202.

Figure 15:
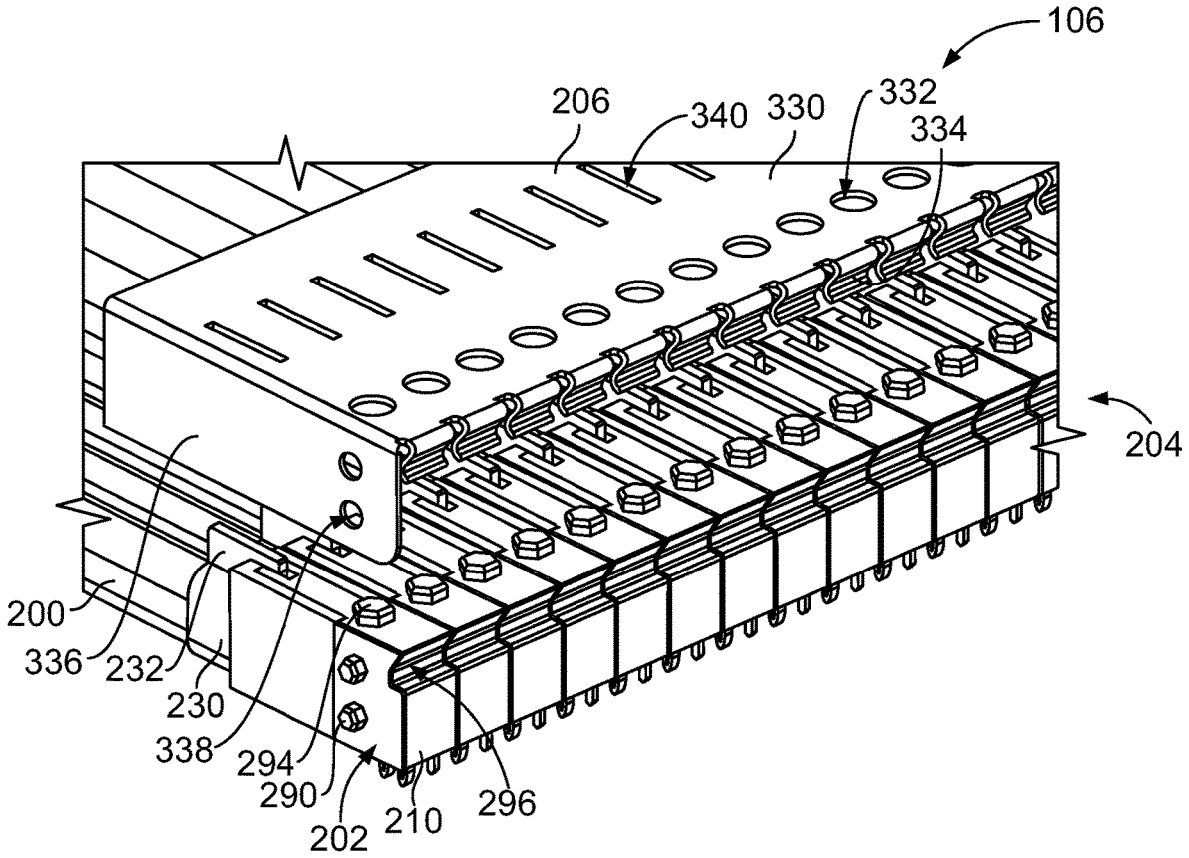
FIG. 15 is a front perspective view of a portion of the cable connector assembly illustrating a ground clip poised for coupling to the cable connectors of the cable connector stack in accordance with an exemplary embodiment.

FIG. 15 is a front perspective view of a portion of the cable connector assembly 106 illustrating the ground clip 206 poised for coupling to the cable connectors 202 of the cable connector stack 204. The ground clip 206 includes a plate 330 configured to extend along the tops of each of the cable connectors 202. The ground clip 206 includes alignment holes 332 that receive corresponding clip alignment features 294 of the cable connectors 202. The ground clip 206 includes retention clips 334 at the front of the plate 330 configured to be received in corresponding clip pockets 296 of the cable connectors 202. The retention clips 334 secure the ground clip 206 to the contact holders 210 of the cable connectors 202. Other types of securing features may be used in alternative embodiments.

In an exemplary embodiment, the ground clip 206 includes an end wall 336 extending from the plate 330. The end wall 336 is configured to engage the end cable connector 202 and provides electrical shielding along the side of the end cable connector 202. The end wall 336 includes stacking alignment holes 338 that receive corresponding stacking alignment bosses 290 of the end cable connector 202.

In an exemplary embodiment, the ground clip 206 includes alignment slots 340 in the plate 330. The alignment slots 340 receive corresponding ferrule tabs 232 of the ferrules 230. The alignment slots 340 are elongated and sized and shaped to receive the ferrule tabs 232. Optionally, the ferrule tabs 232 may be received in the alignment slots 340 by an interference fit. Optionally, the ferrule tabs 232 may include protrusions or bumps to engage the ground clip 206 to ensure electrical connection between the ferrule tabs 232 and the ground clip 206. In other various embodiments, the ground clip 206 may include protrusions or bumps extending into the alignment slots 340 to engage the ferrule tabs 232 to ensure electrical connection between the ferrule tabs 232 and the ground clip 206.

Figure 16:
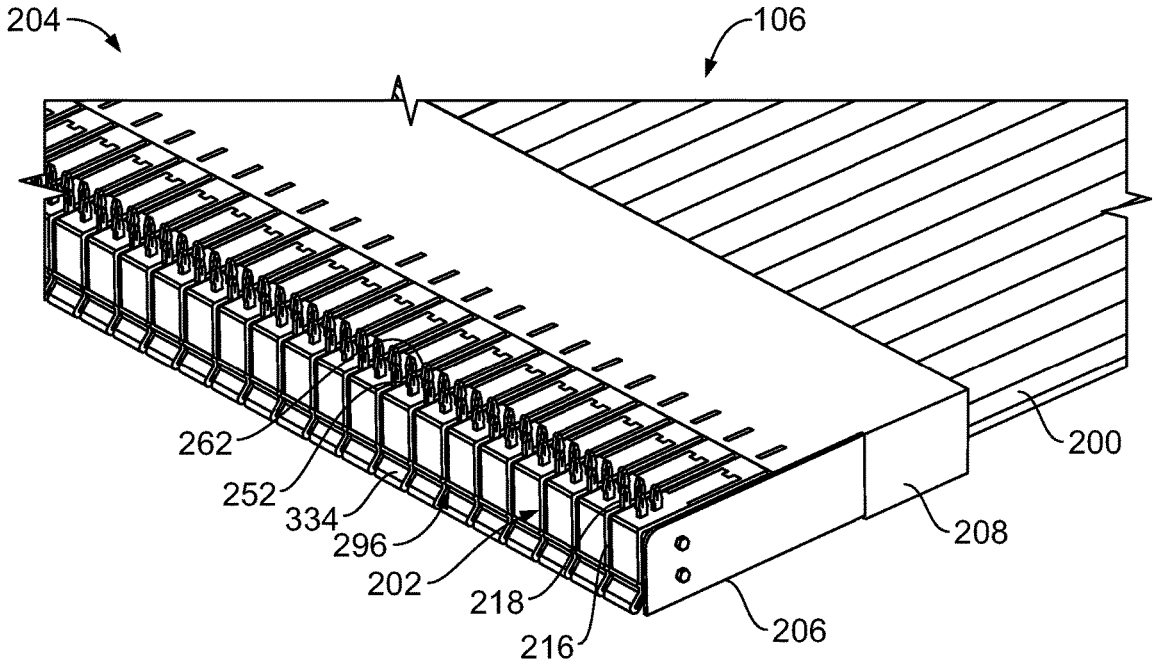
FIG. 16 is a bottom perspective view of a portion of the cable connector assembly in accordance with an exemplary embodiment.
Figure 17:
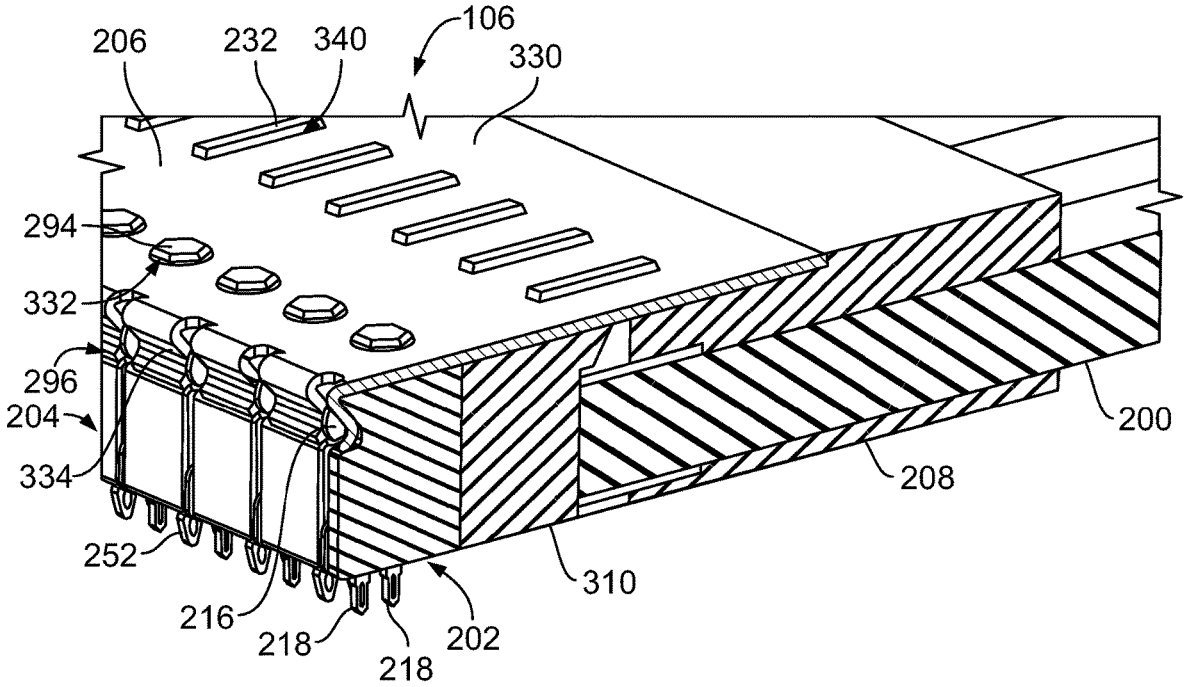
FIG. 17 is a partial sectional view of a portion of the cable connector assembly in accordance with an exemplary embodiment.

FIG. 16 is a bottom perspective view of a portion of the cable connector assembly 106 in accordance with an exemplary embodiment. FIG. 17 is a partial sectional view of a portion of the cable connector assembly 106 in accordance with an exemplary embodiment. FIGS. 16 and 17 illustrate the ground clip 206 coupled to the cable connectors 202. As shown in FIG. 17, the clip alignment features 294 are received in corresponding alignment holes 332 and the ferrule tabs 232 are received in corresponding alignment slots 340. The retention clips 334 are received in corresponding clip pockets 296 to secure the ground clip 206 to the cable connectors 202. The ground shields 216 provide electrical shielding between adjacent cable connectors 202 within the cable connector stack 204. The ground clip 206 provides electrical shielding along the tops of the cable connectors 202 and may provide shielding along one or both ends of the cable connector stack 204. The ground shields 216 are electrically connected to the corresponding ferrule's 230 and the ground clip 206 is electrically connected to corresponding ferrule's 230 through the ferrule tabs 232.

In an exemplary embodiment, the cable holder 208 is coupled to each of the cables 200 and the cable connectors 202. In an exemplary embodiment, the cable holder 208 is coupled to the ground clip 206. The cable holder 208 physically ties together all of the cables 200 and/or the cable connectors 202 within the cable connector assembly 106. The cable holder 208 may provide strain relief for the cables 200. In an exemplary embodiment, the cable holder 208 is formed in place on the cables 200. For example, the cable holder 208 may be overmolded over the cables 200 after the cable connectors 202 are stacked together in the cable connector stack 204. The cable holder 208 may be molded around the ground clip 206, such as under the plate 330 between the cables 200 and the plate 330. The cable holder 208 may be formed against and/or around and/or through the signal conductor holders 310 of the cable connectors 202 to physically tie the cable holder 208 to the cable connectors 202.

After the cable connector assembly 106 is formed, the cable connector assembly 106 may be coupled to the desired substrate, such as the package substrate 116. For example, the substrate terminals 252, 262 and the ground contacts 218 extend from the bottom of the cable connector assembly 106 for termination to the package substrate 116. Each of the cable connectors 202 within the cable connector stack 204 may be coupled simultaneously to the package substrate 116 as a unit. Arranging the cable connectors 202 and the cable connector stack 204 prior to assembly to the package substrate 116 reduces assembly time and complexity by allowing coupling of many cable connectors 202 during a single mounting step.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A cable connector comprising:

a twin-axial cable having a first conductor and a second conductor within a core of the cable;

a first signal contact including a cable terminal and a substrate terminal, the cable terminal being terminated to the first conductor of the cable, the substrate terminal configured to be terminated to a substrate, the cable terminal being generally perpendicular to the substrate terminal;

a second signal contact including a cable terminal and a substrate terminal, the cable terminal being terminated to the second conductor of the cable, the substrate terminal configured to be terminated to the substrate, the cable terminal being generally perpendicular to the substrate terminal;

a contact holder having a body encasing portions of the first and second signal contacts, the contact holder having a front and a rear, the contact holder having a top and a bottom, the cable terminals being arranged proximate to the rear for termination to the cable, the cable extending from the rear of the contact holder, the substrate terminals exposed at the bottom for termination to the substrate; and a ground shield coupled to a first side of the contact holder, the ground shield providing electrical shielding for the cable terminals and the substrate terminals of the first and second contacts.

2. The cable connector of claim 1, wherein the cable is arranged on end such that the cable is tall and narrow.

3. The cable connector of claim 1, wherein the contact holder includes a stacking feature configured to be coupled to an adjacent cable connector for stacking the cable connector with the adjacent cable connector.

4. The cable connector of claim 1, wherein the contact holder includes a stacking alignment boss extending from a first side of the contact holder configured to be coupled to a contact holder of an adjacent cable connector stacked at the first side of the contact holder and the contact holder includes a stacking alignment hole in a second side of the contact holder configured to receive a stacking alignment boss of an adjacent cable connector stacked at the second side of the contact holder.

5. The cable connector of claim 1, wherein the contact holder includes a clip alignment feature configured to engage a ground clip to align the contact holder with the ground clip.

6. The cable connector of claim 1, wherein the body of the contact holder is an overmolded body formed on and encasing portions of the first and second signal contacts.

7. The cable connector of claim 1, wherein the contact holder includes a terminating pocket, the cable terminals being exposed in the terminating pocket, the first and second conductors extending into the terminating pocket for termination to the cable terminals, the contact holder further comprising a signal conductor holder filling the terminal pocket and encasing the cable terminals and the first and second conductors in the terminating pocket.

8. The cable connector of claim 1, wherein the cable includes a ferrule at an end of the cable, the ferrule having a ferrule alignment tab, the contact holder including a ferrule alignment slot receiving the ferrule alignment tab to orient the cable to the contact holder.

9. The cable connector of claim 1, wherein the ground shield includes a ferrule tab electrically connected to a ferrule on the cable to electrically connect the ground shield to the cable.

10. A cable connector comprising:

a twin-axial cable having a first conductor and a second conductor within a core of the cable;

a first signal contact including a cable terminal and a substrate terminal, the cable terminal being terminated to the first conductor of the cable, the substrate terminal configured to be terminated to a substrate, the cable terminal being generally perpendicular to the substrate terminal;

a second signal contact including a cable terminal and a substrate terminal, the cable terminal being terminated to the second conductor of the cable, the substrate terminal configured to be terminated to the substrate, the cable terminal being generally perpendicular to the substrate terminal;

a contact holder having a body encasing portions of the first and second signal contacts, the contact holder having a front and a rear, the contact holder having a top and a bottom, the cable terminals being arranged proximate to the rear for termination to the cable, the cable extending from the rear of the contact holder, the substrate terminals exposed at the bottom for termination to the substrate;

wherein the cable terminal of the first signal contact is located above the cable terminal of the second signal contact and the substrate terminal of the first signal contact is forward of the substrate terminal of the second signal contact.

11. The cable connector of claim 10, further comprising a ground shield coupled to a first side of the contact holder, the ground shield providing electrical shielding for the cable terminals and the substrate terminals of the first and second contacts.

12. A cable connector assembly comprising:

cable connectors arranged side-by-side in a cable connector stack, each cable connector comprising a twin-axial cable having a first conductor and a second conductor within a core of the cable, each cable connector comprising first and second signal contacts terminated to the first and second conductors, respectively, and each cable connector comprising a contact holder having a body holding the first and second signal contacts, the contact holder having a front and a rear, the contact holder having a top and a bottom, the first and second contacts having cable terminals being arranged proximate to the rear for termination to the first and second conductors, the first and second contacts having substrate terminals exposed at the bottom for termination to a substrate, each cable connector comprising a ground shield being electrically grounded to the cable; and a ground clip having a clip plate extending along the top of each contact holder to hold the cable connectors in the cable connector stack with the ground shields arranged between the contact holders of adjacent cable conductors to provide electrical shielding between adjacent cable connectors, the ground clip being electrically connected to each of the ground shields to electrically common each of the cable connectors.

13. The cable connector assembly of claim 12, wherein the cables are arranged on end adjacent each other with first conductors arranged above second conductors such that second conductors are arranged between the first conductors and the substrate.

14. The cable connector assembly of claim 12, wherein the cable terminal of the first signal contact is located above the cable terminal of the second signal contact and the substrate terminal of the first signal contact is forward of the substrate terminal of the second signal contact.

15. The cable connector assembly of claim 12, wherein the contact holders include stacking features coupled to adjacent cable connectors for stacking the cable connectors in the cable connector stack.

16. The cable connector assembly of claim 12, wherein the contact holders include clip alignment features engaging the ground clip to align the contact holders with the ground clip.

17. The cable connector assembly of claim 12, wherein the body of each contact holder is an overmolded body formed on and encasing portions of the first and second signal contacts.

18. The cable connector assembly of claim 12, wherein each cable includes a ferrule at an end of the cable, the ferrule having a ferrule alignment tab, the ground clip including alignment slots receiving corresponding ferrule alignment tabs.

19. An electronic system comprising:

a substrate having substrate contacts, the substrate having an electrical component mounted to an upper surface of the substrate; and a cable connector assembly coupled to the upper surface of the substrate, the cable connector assembly comprising:

cable connectors arranged side-by-side in a cable connector stack, each cable connector comprising a twin-axial cable having a first conductor and a second conductor within a core of the cable, each cable connector comprising first and second signal contacts terminated to the first and second conductors, respectively, and each cable connector comprising a contact holder having a body holding the first and second signal contacts, the contact holder having a front and a rear, the contact holder having a top and a bottom, the first and second contacts having cable terminals being arranged proximate to the rear for termination to the first and second conductors, the first and second contacts having substrate terminals exposed at the bottom for termination to the substrate and electrical connection to the electrical component through the substrate, each cable connector comprising a ground shield being electrically grounded to the substrate; and a ground clip having a clip plate extending along the top of each contact holder to hold the cable connectors in the cable connector stack with the ground shields arranged between the contact holders of adjacent cable conductors to provide electrical shielding between adjacent cable connectors, the ground clip being electrically connected to each of the ground shields to electrically common each of the cable connectors.

20. The electronic system of claim 19, further comprising a second cable connector assembly coupled to the substrate.

* * * * *